US008182263B2

(12) United States Patent
Choi

(10) Patent No.: US 8,182,263 B2
(45) Date of Patent: May 22, 2012

(54) HEAT TREATMENT EQUIPMENT

(76) Inventor: Byung Gil Choi, Gunpo-Si (KR)

( * ) Notice: Subject to any disclaimer, the term of this patent is extended or adjusted under 35 U.S.C. 154(b) by 784 days.

(21) Appl. No.: 12/293,464

(22) PCT Filed: Mar. 14, 2007

(86) PCT No.: PCT/KR2007/001264

§ 371 (c)(1),
(2), (4) Date: Sep. 18, 2008

(87) PCT Pub. No.: WO2008/105573

PCT Pub. Date: Sep. 4, 2008

(65) Prior Publication Data

US 2009/0269713 A1 Oct. 29, 2009

(30) Foreign Application Priority Data

Feb. 28, 2007 (KR) ..... 10-2007-0020360

(51) Int. Cl.
*F27B 9/14* (2006.01)

(52) U.S. Cl. ..... 432/129; 432/133

(58) Field of Classification Search ..... 432/128, 432/129, 133, 136

See application file for complete search history.

(56) References Cited

U.S. PATENT DOCUMENTS 4,338,077 A * 7/1982 Shibayama et al. ..... 432/11
6,190,164 B1 2/2001 Ueno et al.
6,217,317 B1 * 4/2001 Crafton et al. ..... 432/128
6,336,809 B1 * 1/2002 Crafton et al. ..... 432/207
6,544,034 B2 * 4/2003 Watanabe ..... 432/200
6,547,556 B2 * 4/2003 Crafton et al. ..... 432/124
7,090,488 B2 * 8/2006 Murakami et al. ..... 432/128
7,150,627 B2 * 12/2006 Gaur et al. ..... 432/144

FOREIGN PATENT DOCUMENTS

JP 2007-046073 2/2007
KR 1020060055856 5/2006

* cited by examiner

*Primary Examiner* — Gregory A Wilson

(74) *Attorney, Agent, or Firm* — IPLA P.A.; James E. Bame

(57) ABSTRACT

The invention provides a heat treatment apparatus, in which an intake valve (91*a*) is mounted on an ambient gas feed pipe (91) connected to a heating chamber (12), an exhaust valve (131*a*) is mounted on an exhaust pipe (131), and a pressure sensor (150) is provided on the heating chamber (12). Through the control of a control unit (80) connected to the pressure sensor (150), to the intake valve (91*a*) and to the exhaust valve (131*a*), the intake valve (91*a*) and the exhaust valve (131*a*) are opened or closed, thus supplying ambient gas into the heating chamber (12) or exhausting ambient gas from the cooling chamber (13) depending on an internal pressure of the heating chamber (12). Thus, the amount of ambient gas used in heat treating workpieces (1) is minimized and thus operational costs are reduced. It is possible to prevent accidents such as gas explosions as well as to reduce environmental contamination caused by the combustion of ambient gas.

2 Claims, 4 Drawing Sheets

[Fig. 1]
Prior Art
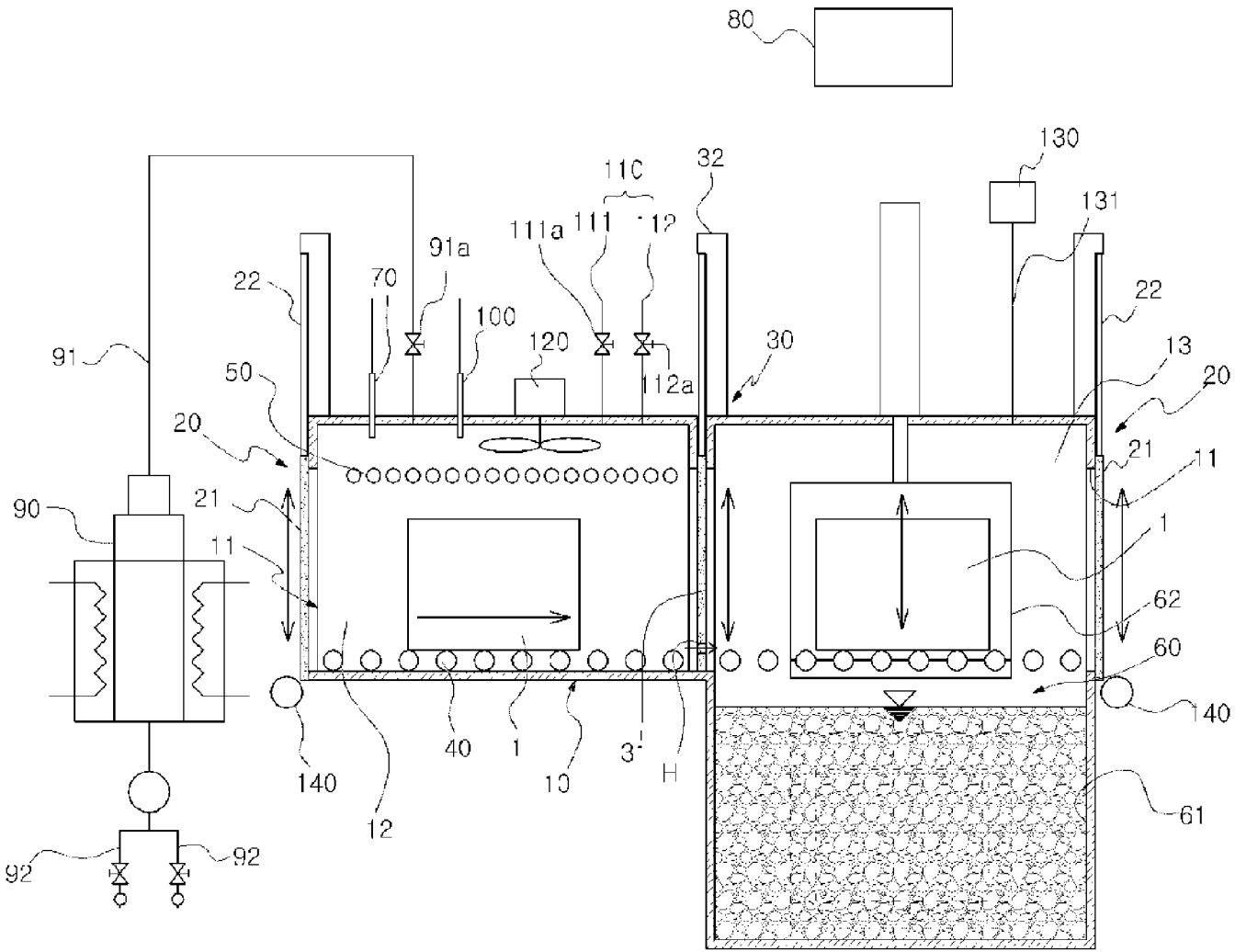

[Fig. 2]
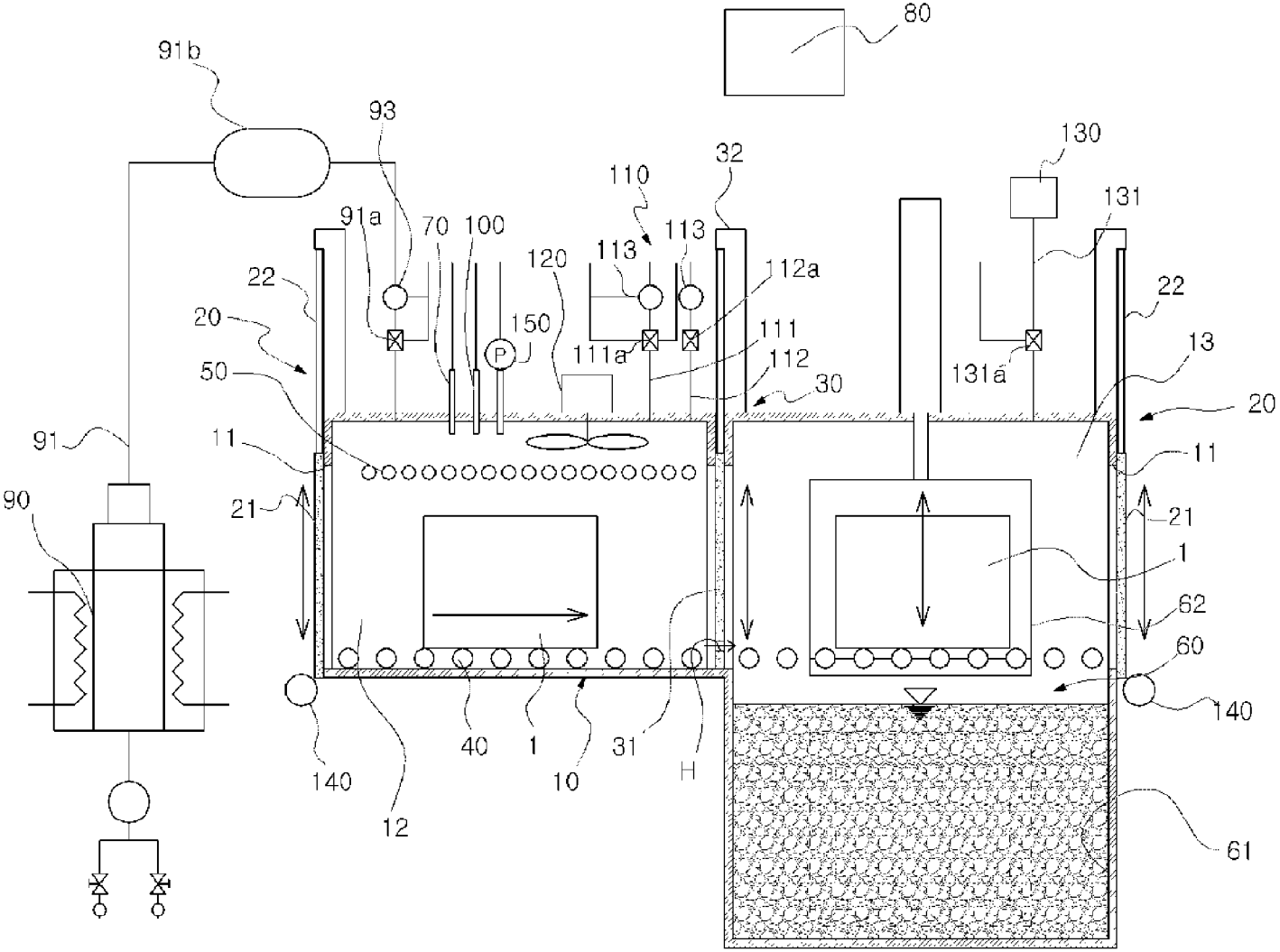

[Fig. 3]
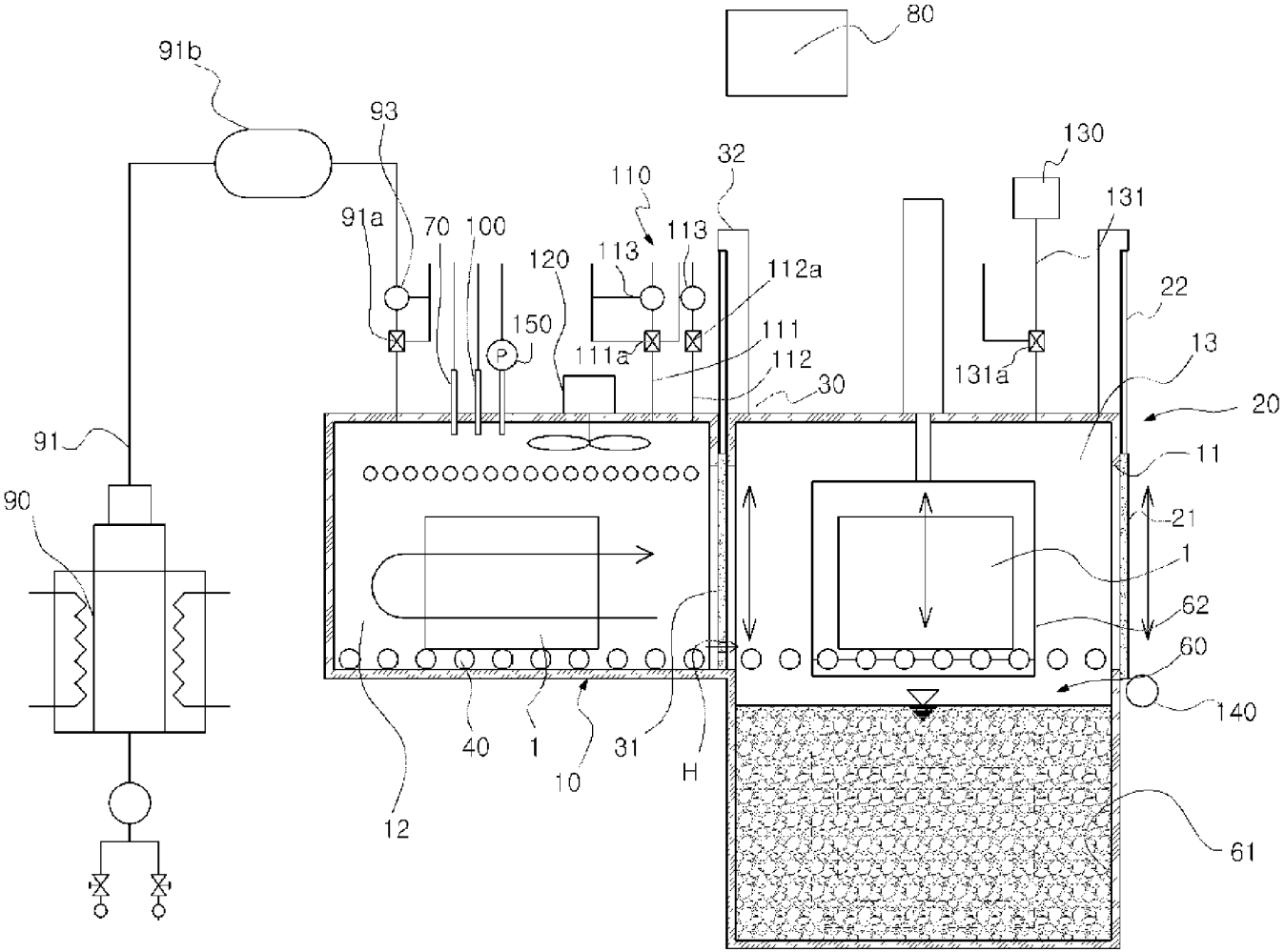

[Fig. 4]
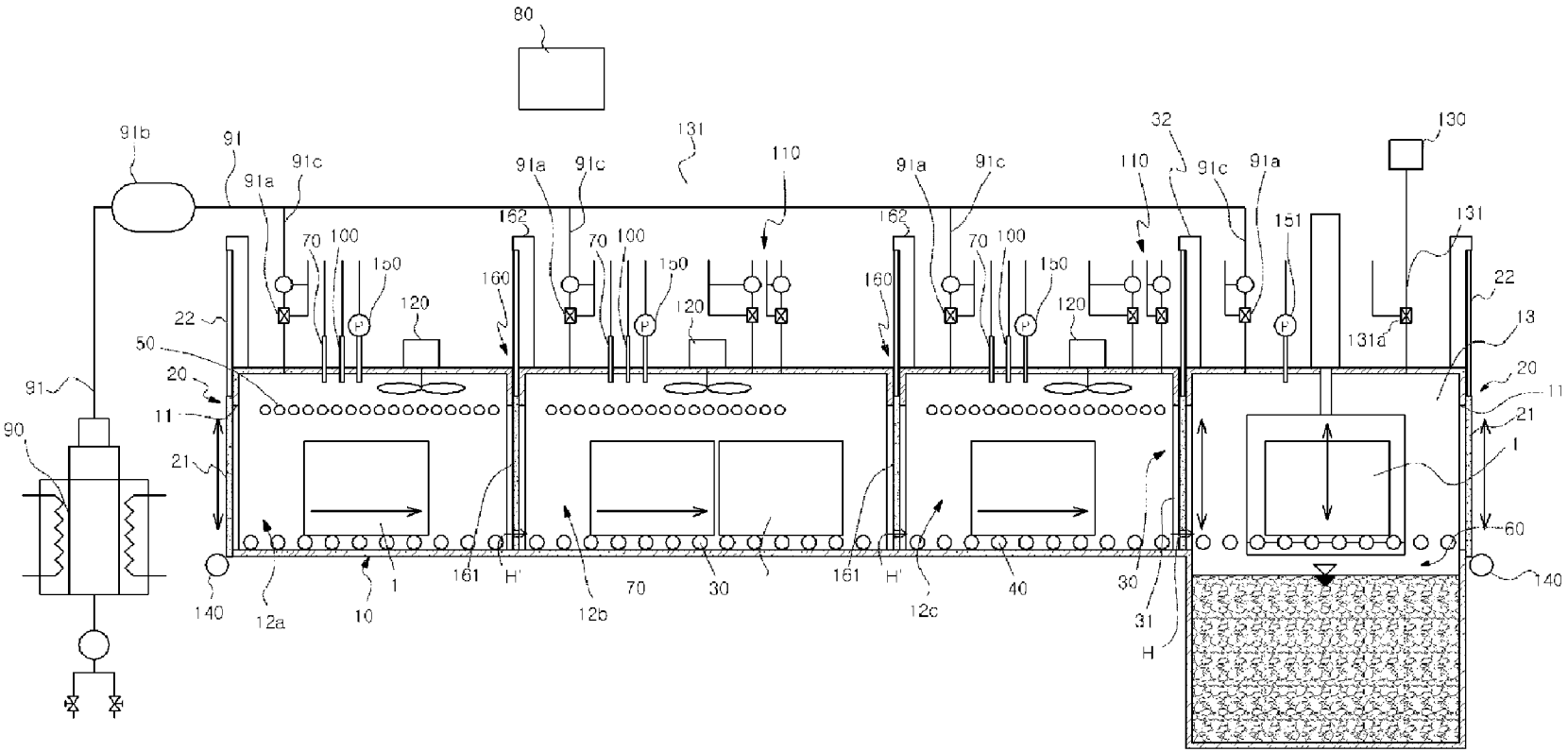

HEAT TREATMENT EQUIPMENT

TECHNICAL FIELD

The present invention relates to a heat treatment apparatus, which is designed to reduce expenses by minimizing ambient gas used for heat treating workpieces, to prevent accidents such as gas explosions, and to reduce environmental contamination caused by the combustion of ambient gas

BACKGROUND ART

As shown in FIG. 1, a heat treatment apparatus, which is usually used in heat treating workpieces, typically comprises: a main body 10, made of refractory material and equipped with a pair of openings 11 through which a workpiece 1 is introduced into and discharged out of the apparatus; opening shutter units 20, mounted on the main body 10 to close and open the openings 11; an internal opening shutter unit 30, openably mounted on the main body 10 so as to divide the interior space of the main body 10 into a heating chamber 12 and a cooling chamber 13 and having a passage hole H which allows communication between the heating chamber 12 and the cooling chamber 13 in a closed condition; a transfer unit 40, to transfer the workpiece 1, which is introduced through the opening 11, to the heating chamber 12 and the cooling chamber 13 and then discharge the workpiece 1 outside through the second opening 11; a heating unit 50 provided in the heating chamber 12 to heat the workpiece 1; a cooling unit 60 provided in the cooling chamber 13 to cool the workpiece 1; a temperature sensor 70 provided on the heating chamber 12 to measure the internal temperature of the heating chamber 12; and a control unit 80 intended to receive an output signal from the temperature sensor 70 and to control the heating unit 50 in response to the output signal, and further to control operations of the opening shutter units 20, the internal opening shutter unit 30 and the transfer unit 40.

The pair of openings 11 is provided in respective opposite sides of the main body 10 to allow access to the heating chamber 12 and the cooling chamber 13, so that the workpiece 1 can be introduced into the heating chamber 12 through one of the openings 11 and can be discharged from the cooling chamber 13 through the other of the openings 11.

The opening shutter unit 20 is comprised of a door panel 21 mounted on the main body 10, and an actuator 22 connected to the door panel 21 and driven in response to a signal from the control unit 80. In other words, the opening shutter unit 20 is configured so as to operate the door panel 21 in response to the signal from the control unit 80, thus opening or closing the opening 11.

The internal opening shutter unit 30 is comprised of a partition panel 31, which is vertically provided in the main body 10 to be raised and lowered, and an actuator 32, which is connected to the partition panel 31 and driven in response to a signal from the control unit 80. Consequently, through a raising or lowering movement of the partition panel 31 by the actuator 32, the heating chamber 12 and the cooling chamber 13 are communicated with each other or are blocked from each other.

The transfer unit 40 is largely comprised of conveying rollers, which are internally disposed on the bottom of the main body 10 and driven by a drive motor (not shown), the heating unit 50 is largely comprised of an electric heater, and the cooling unit is largely comprised of an oil cooling type of cooling apparatus comprised of a cooling oil tank provided at a lower position of the cooling chamber 13 and storing a cooling agent therein, and an elevating apparatus 62 intended to lower and raise the workpiece 1, transferred into the cooling chamber 13, thus immersing the workpiece 1 in the cooling agent.

Consequently, according to a heating sequence, which has been previously programmed, the control unit 80 controls the opening shutter units 20, the internal opening shutter unit 30, the transfer unit 40 and the heating unit 50 such that the workpiece 1, which is introduced into the heating chamber 12, is heated to a predetermined temperature, and is transferred into the cooling chamber 13, in which the workpiece is cooled, thus completing the heat treatment. In this regard, the control unit 80 controls the heating unit 50, according to the internal temperature of the heating chamber 12, which is measured by the temperature sensor 70, thus maintaining the internal temperature of the heating chamber 12 constant.

In this heat treatment apparatus, when air is introduced into the apparatus during the heat treatment, oxygen in the air reacts with the workpiece 1, thus forming an oxide film on the workpiece or deteriorating the inherent physical properties of the workpiece 1.

To overcome this problem, a proper kind of ambient gas is supplied into the heating chamber using an ambient gas supply apparatus 90 connected to the heating chamber 12, thus preventing the introduction of oxygen and securing consistent quality of the heat-treated workpiece 1.

The ambient gas is largely comprised of Rx gas, which is produced by mixing hydrocarbon-based gas, such as natural gas, propane gas, butane gas and the like with air in respective adequate amounts and passing the mixture through a reaction catalyst heated to a temperature of 100-1100° C. The gas supply apparatus 90 is connected to the heating chamber 12 via an ambient gas feed pipe 91 so as to supply ambient gas into the heating chamber 12. A feed pipe 92 is connected to the ambient gas supply apparatus 90 to supply hydrocarbon-based gas and air thereto. The ambient gas feed pipe 91 is provided with an intake valve 91*a* so as to control the amount of ambient gas supplied through the ambient gas feed pipe 91.

The heating chamber 12 further includes an analyzer 100 for analyzing the composition of the ambient gas in the heating chamber 12, a supplemental gas supply unit 110 for additionally supplying hydrocarbon-based gas and air to the heating chamber 12, a fan 120 and the like. The supplemental gas supply unit 110 comprises a hydrocarbon-based gas feed pipe 111, an air feed pipe 112, and control valves 111*a* and 112*a*, which are provided on intermediated portions of the gas feed pipe 111 and the air feed pipe 112, respectively.

As a result, when adequate amounts of hydrocarbon-based gas and air are supplied to the heating chamber 12 by controlling the control valves 111*a* and 112*a* depending on the composition ratio, analyzed using the analytical instrument, the hydrocarbon-based gas and the air are mixed with each other in the heating chamber 12 and react with each other due to the high internal temperature of the heating chamber 12, thus generating the ambient gas. This therefore enables the control of the composition ratio of the ambient gas.

The partition panel 31 of the internal opening shutter unit 30 includes the passage hole H formed therein, which allows the heating chamber 12 and the cooling chamber 13 to be communicated with each other. The cooling chamber 13 is provided with an exhaust pipe 131. Consequently, the ambient gas, which is supplied in the heating chamber 12, is introduced into the cooling chamber 13 through the passage hole H or the opening defined by the opened partition panel 31 of the internal opening shutter unit 30, and is then discharged outside through the exhaust pipe 131. In this arrangement, the passage hole H is provided by forming a through-hole in the lower part of the partition panel 31.

Therefore, when an amount of ambient gas sufficient to maintain the internal pressure of the heating chamber 12 higher than atmospheric pressure is supplied into the heating chamber 12, the ambient gas is also introduced into the cooling chamber 13, thus blocking the introduction of external air thereinto. As a result, it is possible to prevent the heated workpiece 1 from contacting the external air, thus enhancing the quality of the heat-treated workpiece 1.

Meanwhile, because the ambient gas is combustible and toxic gas, if the ambient gas is discharged outside without any treatment, it causes undesirable accidents such as gas poisoning, fires, explosions and the like. To avoid the problem, the waste ambient gas, which is discharged through the exhaust pipe 131, is completely burned in a first combustor 130 connected to the exhaust pipe 131, and is then discharged into the atmosphere. Furthermore, because there is a possibility of ambient gas leaking from the heat treatment apparatus at the time of opening of the openings 11, a pair of second combustors 140, which is connected to the control unit 80, is externally mounted under the openings 11 of the heating chamber 12 and the cooling chamber 13, respectively. Consequently, when the opening is opened by actuation of the opening shutter unit 20, the second combustor 140 is activated to thus burn the ambient gas discharged through the opening 11, thus reliably preventing the ambient gas from being discharged outside. In addition, when the second combustor 140 is activated, a flame-proof curtain is formed outside the opening 11, so that the ambient gas in the main body 10 and the external air cannot be mixed with each other, thus efficiently preventing the ambient gas from leaking outside.

In this heat treatment apparatus, the internal temperature may vary due to the workpiece introduced into the main body, or the internal pressure of the heating chamber 12 and the cooling chamber 13 may be varied by the openings in the opening shutter units 20 and the internal opening shutter unit 30. When the internal pressure is lowered in this way, external air may be introduced into the main body. In particular, if the internal pressure of the cooling chamber 13 is lowered, external air may flow backward into the cooling chamber 13 through the exhaust pipe 131. Therefore, the intake valve 91*a* is opened to the maximum extent, so that a large amount of ambient gas is continuously supplied into the heating chamber 12, thereby increasing the internal pressure of the heating chamber 12 and the cooling chamber. With the result that the backward flow of external air along the exhaust pipe 131 is prevented, and even if the internal pressure of the heating chamber 12 and the cooling chamber 13 are instantaneously decreased, the decreased internal pressure can be restored to normal pressure in a short period of time.

Therefore, the conventional heat treatment apparatus has problems in that consumption of the ambient gas is drastically increased, and the operational cost is correspondingly increased.

In addition thereto, when a workpiece 1, which is in a cooled state, is introduced into the heating chamber 12 or a heated workpiece 1 is rapidly cooled by the cooling unit, the internal temperature of the heating chamber 12 and the cooling chamber 13 are rapidly lowered and the internal pressure is also rapidly decreased due to the lowered temperature. At this point, since the ambient gas supply unit supplies a constant amount of ambient gas in a continuous manner, there is a limit to how quickly the lowered internal pressure can be restored to normal pressure. For this reason, external air is introduced into the chambers, thus causing the composition of the ambient gas to be unsteady. As a result, there are undesirable problems in that it is difficult to secure heat-treated products having a good quality, and explosion accidents may occur when the mixing ratio of ambient gas and air reaches the explosion region of the mixture.

Further, there are additional problems in which, since a large amount of ambient gas is used, additional costs are incurred in order to burn the ambient gas which is discharged outside, and the combustion of the ambient gas induces the generation of a large amount of carbon dioxide gas, thus causing environmental contamination.

DISCLOSURE OF INVENTION

Technical Problem

Accordingly, the present invention has been made keeping in mind the above problems occurring in the prior art, and an object of the present invention is to provide a heat treatment apparatus which is designed to reduce ambient gas used in heat treating workpieces to the minimum and thus reduce operational costs, to prevent accidents such gas explosions, and to alleviate environmental contamination caused by the combustion of the ambient gas.

Technical Solution

In order to accomplish the above object, the present invention provides a heat treatment apparatus, comprising: a main body made of refractory material and equipped with at least one opening through which a workpiece is introduced into and discharged out of the apparatus; at least one opening shutter unit mounted on the main body to close and open the at least one opening; an internal opening shutter unit openably mounted on the main body so as to divide the interior space of the main body into a heating chamber and a cooling chamber, and having a passage hole which allows communication between the heating chamber and the cooling chamber in the closed condition; a transfer unit to transfer the workpiece, which is introduced through the at least one opening, to the heating chamber and the cooling chamber and to then discharge the workpiece outside through the at least one opening; a heating unit provided in the heating chamber to heat the workpiece; a cooling unit provided in the cooling chamber to cool the workpiece; an ambient gas supply unit connected to the heating chamber via an ambient gas feed pipe equipped with an intake valve so as to supply ambient gas into the heating chamber; a first combustor connected to the cooling chamber via an exhaust pipe so as to burn the ambient gas from the cooling chamber and then discharge the burned ambient gas outside; at least one second combustor disposed outside of the at least one opening of the main body so as to burn the ambient gas discharged out of the at least one opening; a temperature sensor provided on the heating chamber to measure an internal temperature of the heating chamber; and a control unit for receiving an output signal from the temperature sensor and controlling the heating unit in response to the output signal, and further for controlling operation of the at least one opening shutter unit, the internal opening shutter unit, the transfer unit and the at least one second combustor;

wherein the intake valve is a solenoid valve, operation of which is controlled by the control unit, and the heat treatment apparatus further comprises an exhaust valve including a solenoid valve, which is provided on the exhaust pipe and operation of which is controlled by the control unit; and a pressure sensor provided on the heating chamber to measure an internal pressure of the heating chamber, whereby the control unit receives a pressure value measured by the pressure sensor, and controls operations of the intake valve and the exhaust valve and thus a supply and discharge of ambient gas depending on the pressure value.

Advantageous Effects

As described above, according to the heat treatment apparatus, an intake valve 91*a* is mounted on an ambient gas feed pipe 91 connected to a heating chamber 12, an exhaust valve 131*a* is mounted on an exhaust pipe 131, and a pressure sensor 150 is provided on the heating chamber 12. Through the control of a control unit 80 connected to the pressure sensor 150, the intake valve 91*a* and the exhaust valve 131*a*, the intake valve 91*a* and the exhaust valve 131*a* are opened or closed, thus supplying ambient gas into the heating chamber 12 or exhausting ambient gas in the cooling chamber 13, depending on the internal pressure of the heating chamber 12. Thus, the amount of ambient gas used in heat treating workpieces 1 is minimized and thus operational costs are reduced. It is possible not only to prevent accidents such as gas explosions but also to reduce environmental contamination caused by the combustion of ambient gas.

BRIEF DESCRIPTION OF THE DRAWINGS

FIG. 1 is a schematic illustration of a conventional heat treatment apparatus;

FIG. 2 is a schematic illustration of a heat treatment apparatus according to the present invention;

FIG. 3 is a schematic illustration of a heat treatment apparatus according to a second embodiment of the present invention; and FIG. 4 is a schematic illustration of a heat treatment apparatus according to a third embodiment of the present invention.

DESCRIPTION OF REFERENCE NUMERALS IN DRAWINGS

10; main body 11; opening
12; heating chamber 13; cooling chamber
20; opening shutter unit 30; internal opening shutter unit
40; transfer unit 50; heating unit
60; cooling unit 70; temperature sensor
80; control unit 90; ambient gas supply unit
91; ambient gas feed pipe 91*a*; intake valve
91*b*; storage tank 91*c*; branch pipe
100; ambient gas analyzer 110; supplemental gas supply unit
120; fan 130; first combustor
131; exhaust pipe 131*a*; exhaust valve
140; second combustor 150; pressure sensor

MODE FOR THE INVENTION

The present invention will be described in more detail with reference to the accompanying drawings.

Referring to FIG. 2, a heat treatment apparatus according to the present invention comprises: a main body 10 made of refractory material and equipped with a pair of openings 11 through which a workpiece 1 is introduced into and discharged out of the apparatus; opening shutter units 20 mounted on the main body 10 to close and open the pair of openings 11; an internal opening shutter unit 30 openably mounted on the main body 10 so as to divide the interior space of the main body 10 into a heating chamber 12 and a cooling chamber 13 and having a passage hole H which allows communication between the heating chamber 12 and the cooling chamber 13 in the closed condition; a transfer unit 40 to transfer the workpiece 1, which is introduced through the opening 11, to the heating chamber 12 and the cooling chamber 13 and then discharge the workpiece 1 outside through the second opening 11; a heating unit 50 provided in the heating chamber 12 to heat the workpiece 1; a cooling unit 60 provided in the cooling chamber 13 to cool the workpiece 1; an ambient gas supply unit 90 connected to the heating chamber 12 via an ambient gas feed pipe 91 equipped with an intake valve 91*a* so as to supply ambient gas into the heating chamber; a first combustor 130 connected to the cooling chamber 13 via an exhaust pipe 131 so as to burn the ambient gas from the cooling chamber and then discharge the burned ambient gas outside; a pair of second combustors 140 disposed outside the openings 11 of the main body 10 so as to burn the ambient gas discharged out of the opening 11; a temperature sensor 70 provided on the heating chamber 12 to measure the internal temperature of the heating chamber 12; and a control unit 80 intended to receive an output signal from the temperature sensor 70 and to control the heating unit 50 in response to the output signal, and further to control operations of the opening shutter units 20, the internal opening shutter unit 30, the transfer unit 40 and the second combustors 140, all of which are components included in the conventional heat treatment apparatus, which has been described above.

The internal opening shutter unit 30 is comprised of a partition panel 31, which is vertically provided in the main body 10 to be raised and lowered, and an actuator 32, which is connected to the partition panel 31. In this configuration, since the partition panel 31 is provided with the passage hole H to allow communication between the heating chamber 12 and the cooling chamber 13, the ambient gas, which is supplied into the heating chamber 12, is introduced into the cooling chamber 30 through the passage hole H or the opening defined by the opened internal opening shutter unit 30, and is then discharged therefrom through the exhaust pipe 131.

The intake valve 91*a* may be comprised of a flow control solenoid valve, which is connected to the control unit 80 and is controlled by a signal from the control unit 80. Consequently, the intake valve is operated in response to the signal from the control unit 80, so that the amount of ambient gas supplied into the heating chamber 12 through the ambient gas feed pipe 91 can be controlled.

The heat treatment apparatus according to the present invention further comprises an exhaust valve 131 mounted on the exhaust pipe 131, and a pressure sensor 150 provided on the heating chamber 12.

The exhaust valve 131*a* may be comprised of a flow control solenoid valve, which is connected to the control unit 80 and which is operated to precisely control the amount of ambient gas discharged into the first combustor 130 through the exhaust pipe 131, in response to the signal from the control unit 80.

The pressure sensor 150 may be comprised of a rod type pressure sensor including a pressure-sensing rod, which passes through a wall of the main body 10 and protrudes into the heating chamber 12, or may be comprised of any sensor mounted on a pipe connected to the heating chamber 12 such that it can measure the internal pressure of the heating chamber 12 from the outside thereof. The pressure sensor 150 is connected to the control unit 80, and functions to measure the internal pressure of the heating chamber 12 and then sends the pressure value to the control unit 80.

The control unit 80, which is provided with a memory, in which a predetermined pressure value is stored, compares the predetermined pressure value with a pressure value measured by the pressure sensor 150, and controls the degrees of opening of the intake valve 91*a* and the exhaust valve 131*a* depending on the result of the comparison, so that the amount of ambient gas supplied into the heating chamber 12 through the ambient gas feed pipe 91 and the amount of ambient gas discharged from the cooling chamber 13 through the exhaust pipe 131 can be controlled. In this case, the first combustor 130 is designed to operate in conjunction with the exhaust valve 131*a* such that the first combustor 130 operates only when the exhaust valve 131*a* is opened, and thus the ambient gas is discharged through the exhaust pipe 131.

The ambient gas feed pipe 91 is provided with a storage tank 91*b* for storing ambient gas supplied from the ambient gas supply unit 90. The storage tank 91*b* is constructed to be capable of storing high pressure gas, so that it stores high pressure ambient gas generated from the ambient gas supply unit 90 and supplies the high pressure ambient gas into the heating chamber 12 at the time of the opening of the intake valve 91*a*.

Therefore, when the internal pressure of the heating chamber 12 or the cooling chamber 13 is lower than the pressure value stored in the memory of the control unit 80 on account of the opening of the opening shutter unit 20 or the temperature variation while both the intake valve 91*a* and the exhaust valve 131*a* remain closed, the control unit 80 makes the intake valve 91*a* open depending on the signal from the pressure sensor 150, so that the ambient gas is supplied into the heating chamber 12, and thus the internal pressure of the heating chamber 12 and the cooling chamber 13 is restored to normal pressure. Subsequently, when the internal pressure is restored to normal pressure, the intake valve 91*a* is closed, thus blocking the further supply of the ambient gas.

Meanwhile, when the internal pressure of the cooling chamber 13 is increased because the internal temperature of the cooling chamber 13 is increased due to the introduction of the workpiece 1, heated in the heating chamber 12, into the cooling chamber 13, or the ambient gas is excessively supplied into the cooling chamber 13, the increased internal pressure is transmitted to the heating chamber 12 through the passage hole H. At this point, the control unit 80 makes the exhaust valve 131*a* open in response to the signal from the pressure sensor 150, and thus the ambient gas in the cooling chamber 13 is discharged through the exhaust valve 131*a*, thus lowering the internal pressure of the cooling chamber 13. Subsequently, when the internal pressure of the cooling chamber 13 is restored to normal pressure, the exhaust valve 131*a* is closed, thus blocking the backflow of external air into the cooling chamber 13 through the exhaust pipe 131.

In this case, the control unit 80 conducts the comparison between the predetermined pressure value stored in the memory and the pressure value measured by the pressure sensor 150. As a result, as the difference between the two pressure values increases, the degree of opening of the intake valve 91*a* and the exhaust valve 131*a* is correspondingly increased. While the intake valve 91*a* remains closed, the ambient gas generated from the ambient gas supply unit 90 is first stored in the storage tank 91*b* through the ambient gas feed pipe 91, and is then supplied into the heating chamber 12 at the time of the opening of the intake valve 91*a*.

The heating chamber 12 is further provided with an ambient gas analyzer 100 for analyzing the composition of the ambient gas in the heating chamber 12, a supplemental gas supply unit 110 for additionally supplying hydrocarbon-based gas and air into the heating chamber 12, a fan 120 and the like.

The ambient gas analyzer 100 is connected to the control unit 80, and functions to analyze the composition ratio of the ambient gas in the heating chamber 12 and to transmit the analyzed data of the composition ratio to the control unit 80.

The supplemental gas supply unit 110 is comprised of a hydrocarbon-based gas feed pipe 111 and an air feed pipe 112, in which control valves 111*a* and 112*a* are provided on intermediate portions of the gas feed pipe 111 and the air feed pipe 112, respectively.

Accordingly, when the ambient gas analyzer 100 analyzes the ambient gas in the heating chamber 12 and transmits the resulting data of the composition ratio to the control unit 80, the control unit 80 conducts the comparison between the composition ratio value previously stored in the memory and the composition ratio analyzed by the ambient gas analyzer 100. In this case, if, as a result of the comparison, the two composition ratios are found to be different from each other, the control valves are opened, so that an adequate amount of hydrocarbon-based gas and air is further supplied into the heating chamber 12, thus controlling the composition ratio of the ambient gas in the heating chamber 12.

The ambient gas feed pipe 91 is further provided with a flow meter 93, and the hydrocarbon-based gas feed pipe 111 and the air feed pipe 112 are further provided with flow meters 113, all of the flow meters being connected to the control unit 80. Consequently, it is possible to conduct the feedback control of the amount of the gas supplied through the ambient gas feed pipe 91 and the supplemental gas feed pipes.

Unlike the conventional heat treatment apparatus, which must always supply an abundant amount of ambient gas, the heat treatment apparatus having the above-described construction is adapted to supply ambient gas through the opened intake valve 91*a* only when the internal pressure in the heating chamber 12 or the cooling chamber 13 is lower than the set pressure stored in the control unit 80. Therefore, the heat treatment apparatus according to the present invention has advantages in that the amount of consumption of ambient gas is drastically reduced, and thus the operational costs are correspondingly reduced.

When the internal pressure of the heating chamber 12 and the cooling chamber 13 is rapidly lowered because the opening shutter unit 20 is opened or the heated workpiece 1 is rapidly cooled by the cooling chamber, the control unit 80 makes the intake valve 91*a* open completely, thus allowing the supply of the maximum amount of ambient gas into the heating chamber 12 and the cooling chamber 13. With the supply of ambient gas, the composition ratio of the ambient gas in the heating chamber 12 and the cooling chamber 13 remains in an optimal state, and thus it is advantageously possible to prevent a deterioration in the quality of the heat-treated products due to the varying composition of the ambient gas, and to prevent the occurrence of explosions when the mixing ratio of ambient gas and air falls within an explosive mixture range.

In particular, since the ambient gas feed pipe 91 is provided with the storage tank 91*b* so as to compress and store the ambient gas, which is continuously generated from the ambient supply unit 90, under high pressure, it is possible to deal with the case in which a large amount of ambient gas is suddenly required.

Further, since the exhaust pipe 131 is provided with the exhaust valve 131*a* such that the ambient gas is discharged only when the internal pressure of the heating chamber 12 or the cooling chamber 13 is higher than a predetermined pressure value, there is an advantage in that it is possible to drastically reduce the amount of CO generated during the combustion of the discharged ambient gas in the first combustor 130. In particular, since the first combustor 130 is operated only during the discharge of ambient gas, there is another advantage in that it is possible to prevent an additional increase in costs required to operate the first combustor 130.

In this embodiment, although the passage hole H has been described as being formed by forming a through-hole in a predetermined position in the partition panel 31, the passage hole may be replaced with a gap, which is defined between the lower end of the partition panel 31 and the main body 10, so that the ambient gas can pass through the gap.

FIG. 3 shows a second embodiment of the present invention, in which the main body 10 is provided with only one opening 11 which allows communication with the cooling chamber 13 so that a workpiece 1 can be transferred into the heating chamber 12 through the cooling chamber 13.

In this case, since the heating chamber 12 does not directly open toward the outside, there is an advantage in that it is possible to reduce the amount of the ambient gas supplied into the heating chamber 12.

FIG. 4 shows a third embodiment of the present invention, in which the heating chamber 12 is provided with subsidiary internal opening shutter units 160 to divide the internal space of the heating chamber 12 into first to third sub-heating chambers 12*a*, 12*b*, 12*c*, so that various heat treatments under different temperature conditions can be conducted in the first to third sub-heating chambers 12*a*, 12*b*, 12*c*, respectively, thus enabling more complicated heat treatment. Each of the subsidiary internal opening shutter units 160 is comprised of a partition panel 161, which is vertically provided in the main body 10 to be raised and lowered, and an actuator 162 connected to the partition panel 161. The partition panels 161 include passage holes H such that the sub-heating chambers 12*a*, 12*b*, 12*c* communicate with each other.

Each of the first to third sub-heating chambers 12*a*, 12*b*, 12*c* is provided with a temperature sensor 70, an ambient gas analyzer 100 and a pressure sensor 150, all of which are connected to the control unit 80, so as to analyze the temperature and the pressure thereof and the composition of the ambient gas therein. Further, the second and third sub-heating chambers 12*b* and 12*c* are provided with respective supplemental gas supply units 110. In this embodiment, the ambient gas feed pipe 91 includes at the end thereof a manifold structure, from which a plurality of branch pipes 91*c* diverge. The branch pipes 91*c* are connected to the sub-heating chambers 12*a*, 12*b*, 12*c*, respectively. Each of the plurality of branch pipes 91*c* is provided with an intake valve 91*a* in order to discretely control the amount of ambient gas supplied into the corresponding sub-heating chamber 12.

One of the branch pipes 91*c* of the ambient gas feed pipe 91 is connected to the cooling chamber 13, and the cooling chamber 13 is provided with a pressure sensor 151 for measuring the internal pressure of the cooling chamber 13. The control unit 80 controls the intake valves 19*a* mounted on the branch pipes 91*c*, based on the pressure measurements input from the pressure sensor 151, and allows the supply of ambient gas into the first to third sub-heating chambers 12*a*, 12*b*, 12*c* and the cooling chamber 13.

As described above, the heat treatment apparatus according to the present invention has advantages in that, since ambient gas is directly supplied into the heating chamber 12 and the cooling chamber 13 when the internal pressure of the heating chamber 12 and the cooling chamber 13 is lower than a predetermined value, the internal pressure of the heating chamber 12 and the cooling chamber 13 can be restored to normal pressure, thus further improving the quality of heat treatment.

The invention claimed is:

1. A heat treatment apparatus, comprising:

a main body made of refractory material and equipped with at least one opening through which a workpiece is introduced into and discharged out of the apparatus;

at least one opening shutter unit mounted on the main body to close and open the at least one opening;

an internal opening shutter unit openably mounted on the main body so as to divide the interior space of the main body into a heating chamber and a cooling chamber, and having a passage hole which allows communication between the heating chamber and the cooling chamber in the closed condition;

a transfer unit to transfer the workpiece, which is introduced through the at least one opening, to the heating chamber and the cooling chamber and to then discharge the workpiece outside through the at least one opening;

a heating unit provided in the heating chamber to heat the workpiece;

a cooling unit provided in the cooling chamber to cool the workpiece;

an ambient gas feed unit connected to the heating chamber via an ambient gas feed pipe equipped with an intake valve so as to supply ambient gas into the heating chamber;

a first combustor connected to the cooling chamber via an exhaust pipe so as to burn the ambient gas from the cooling chamber and then discharge the burned ambient gas outside;

at least one second combustor disposed outside of the at least one opening of the main body so as to burn the ambient gas discharged out of the at least one opening;

a temperature sensor provided on the heating chamber to measure an internal temperature of the heating chamber; and a control unit for receiving an output signal from the temperature sensor and controlling the heating unit in response to the output signal, and further for controlling operation of the at least one opening shutter unit, the internal opening shutter unit, the transfer unit and the at least one second combustor;

wherein the intake value is a solenoid value, operation of which is controlled by the control unit;

the heat treatment apparatus further comprises a pressure sensor for measuring an internal pressure of the heating chamber and transferring the measured pressure value to the control unit so that the intake value and an exhaust valve are controlled, the exhaust valve which is a solenoid valve provided on the exhaust pipe, operation of which is controlled by the control unit, and a storage tank provided on the ambient gas feed pipe to store ambient gas generated from the ambient gas feed unit;

an ambient gas analyzer provided on the heating chamber to analyze a composition of ambient as in the heating chamber; and a supplemental gas supply unit provided on the heating chamber and including a gas feed pipe for supplying hydrocarbon-based gas, an air feed pipe for supplying air, and control valves, each including a solenoid valve, provided on the gas feed pipe and the air feed pipe, respectively, and controlled by the control unit;

wherein the control unit receives data of a composition ratio from the ambient gas analyzer and controls the control valves to allow additional supply of hydrocarbon-based gas and air into the heating chamber, thus controlling a composition of ambient gas in the heating chamber.

2. The heat treatment apparatus according to claim 1, wherein the cooling chamber is connected to the ambient gas supply unit via the ambient gas feed pipe, and the cooling chamber is provided with a pressure sensor for measuring a pressure of the cooling chamber, so that the control unit receives a pressure value measured by the pressure sensor and controls the intake valve mounted on the ambient gas feed pipe to supply ambient gas into the cooling chamber, thus quickly restoring the pressure of the cooling chamber.

* * * * *